US012607137B2

(12) United States Patent
Furukoshi

(10) Patent No.: US 12,607,137 B2
(45) Date of Patent: Apr. 21, 2026

(54) ENGINE WITH REDUCED NOISE

(71) Applicant: TOYOTA JIDOSHA KABUSHIKI KAISHA, Toyota (JP)

(72) Inventor: Taro Furukoshi, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/792,783

(22) Filed: Aug. 2, 2024

(65) Prior Publication Data

US 2025/0163835 A1 May 22, 2025

(30) Foreign Application Priority Data

Nov. 17, 2023 (JP) ..... 2023-195950

(51) Int. Cl.
*F01M 11/04* (2006.01)
*F01M 11/00* (2006.01)

(52) U.S. Cl.
CPC . *F01M 11/0408* (2013.01); *F01M 2011/0008* (2013.01); *F01M 2011/002* (2013.01); *F01M 2011/007* (2013.01)

(58) Field of Classification Search
CPC ..... F01M 11/0004; F01M 11/0408; F01M 11/064; F01M 11/065; F01M 2011/0008; F01M 2011/0012; F01M 2011/002; F01M 2011/007
See application file for complete search history.

(56) References Cited

U.S. PATENT DOCUMENTS 5,014,819 A * 5/1991 Gotou ..... F01M 11/065 184/6.5
7,341,039 B1 * 3/2008 Jaszewski ..... F01M 11/0004 123/196 R
2010/0162988 A1 * 7/2010 Enokida ..... F01M 11/0004 123/195 C
2012/0210971 A1 * 8/2012 Noguchi ..... F01M 11/0004 123/196 R
2016/0333752 A1 * 11/2016 Aldridge ..... F01M 11/064

FOREIGN PATENT DOCUMENTS

JP H04-134172 A 5/1992
JP 2005083228 A * 3/2005
JP 2015-124697 A 7/2015

OTHER PUBLICATIONS

JP-2005083228-A English Translation.*

* cited by examiner

*Primary Examiner* — Minh Truong
(74) *Attorney, Agent, or Firm* — SoraIP, Inc.

(57) ABSTRACT

An engine comprising: a crankcase having an opening at a lower portion thereof; and an oil pan connected to a lower portion of the crankcase so as to close the opening, wherein the crankcase includes a reinforcing plate portion integrally formed with the crankcase so as to span the opening.

2 Claims, 5 Drawing Sheets

ENGINE WITH REDUCED NOISE

CROSS-REFERENCE TO RELATED APPLICATION

This application claims priority to Japanese Patent Application No. 2023-195950 filed on Nov. 17, 2023, incorporated herein by reference in its entirety.

BACKGROUND

1. Technical Field

The present disclosure relates to an engine.

2. Description of Related Art

An oil pan is connected to a crankcase of an engine so as to block an opening portion at a lower portion of the crankcase (see Japanese Unexamined Patent Application Publication No. 2015-124697 (JP 2015-124697 A), for example).

SUMMARY

Rigidity is low around the opening portion of the crankcase. Therefore, vibrations caused by the combustion stroke, rotation of a crankshaft, and the like are easily transmitted to the periphery of the opening portion of the crankcase. As a result, the vibrations may be transmitted to the oil pan, and vibration noise may increase.

Thus, it is an object of the present disclosure to provide an engine in which vibration noise is suppressed.

The above object can be achieved by an engine including: a crankcase that has an opening portion in a lower portion; and an oil pan connected to the lower portion of the crankcase so as to block the opening portion, in which the crankcase includes a reinforcing plate portion formed integrally with the crankcase so as to span the opening portion.

The crankcase may include a rib portion that extends from an edge of the opening portion to the reinforcing plate portion.

The engine may further include an oil strainer; the reinforcing plate portion may include a through hole; the oil strainer may include a pipe member and a case member; the case member may have an inlet port and an outlet port; the pipe member may be fixed to a lower surface of the reinforcing plate portion so as to communicate with the through hole; and the case member may be fixed to an upper surface of the reinforcing plate portion such that the inlet port communicates with the through hole.

The case member may protrude from the reinforcing plate portion and cover a part of the opening portion when the crankcase is seen from above.

According to the present disclosure, it is possible to provide an engine in which vibration noise is suppressed.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
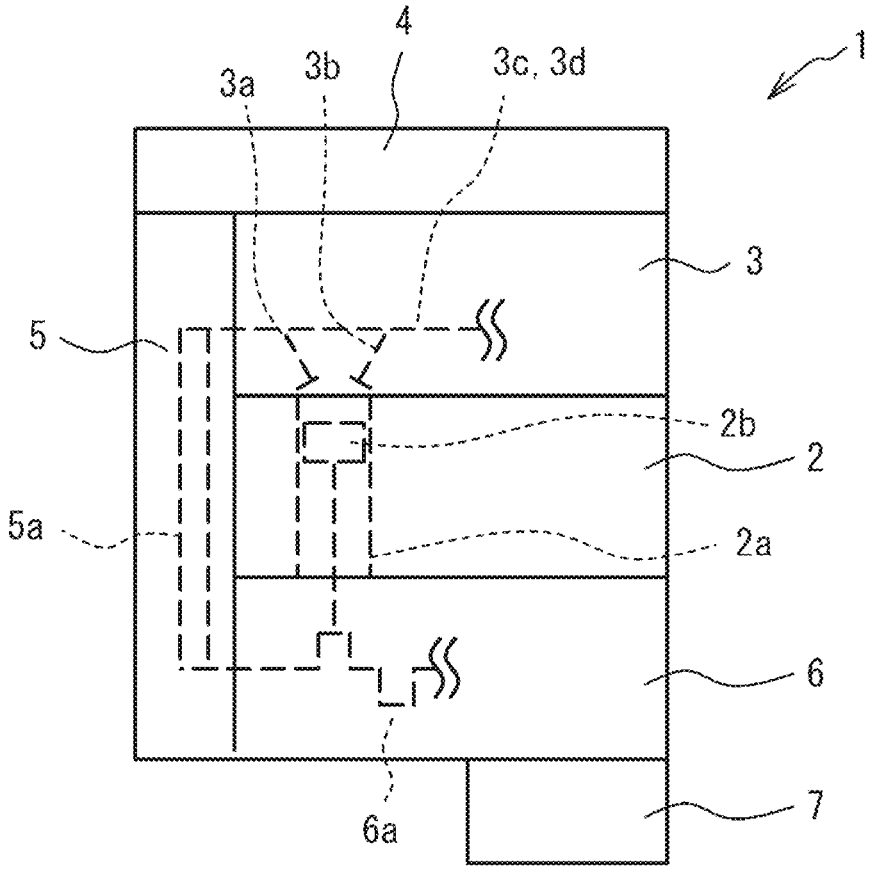
FIG. 1 is a schematic configuration diagram of an engine.

FIG. 1 is a schematic configuration diagram of an engine 1. The engine 1 includes a cylinder block 2, a cylinder head 3, a head cover 4, a chain cover 5, a crankcase 6, and an oil pan 7. The cylinder head 3 is attached to an upper portion of the cylinder block 2. The head cover 4 is attached to an upper portion of the cylinder head 3 and an upper portion of the chain cover 5. The crankcase 6 is attached to a lower portion of the cylinder block 2. The oil pan 7 is attached to a lower portion of the crankcase 6. The chain cover 5 is attached to a side surface of the cylinder block 2, a side surface of the cylinder head 3, and a side surface of the crankcase 6.

A plurality of cylinder 2*a* in which the piston 2*b* is accommodated are provided in the cylinder block 2. In FIG. 1, only a pair of cylinder 2*a* and a piston 2*b* are shown. In the cylinder head 3, an intake valve 3*a* for opening and closing the cylinder 2*a* and an intake camshaft 3*c* and an exhaust camshaft 3*d* for driving the exhaust valve 3*b* are provided. In the crankcase 6, a crankshaft 6*a* that rotates by reciprocating motion of the piston 2*b* is provided. A chain 5*a* that transmits the rotation of the crankshaft 6*a* to the intake camshaft 3*c* and the exhaust camshaft 3*d* is accommodated in the chain cover 5. Engine oil for lubricating the sliding portion of the engine 1 is stored in the oil pan 7.

Figure 2:
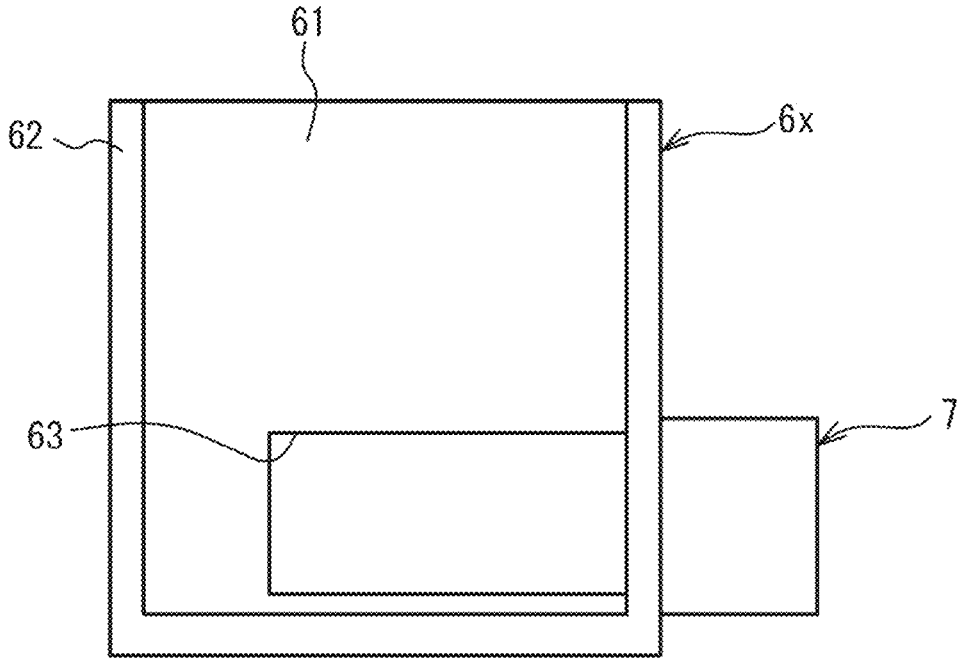
FIG. 2 Prior Art
FIG. 2 is a top view of a crankcase and an oil pan of a comparative example.

Before describing the crankcase 6 of the present embodiment, the crankcase 6*x* of the comparative example will be described. FIG. 2 is a view of the crankcase 6*x* and the oil pan 7 from above. In FIG. 2, the chain cover 5 is disposed on the upper side of the paper surface of the crankcase 6*x*. The crankcase 6*x* includes a bottom wall portion 61 and a side wall portion 62 formed at a peripheral edge of the bottom wall portion 61. An opening portion 63 communicating with the oil pan 7 is formed in the bottom wall portion 61. The engine oil stored in the oil pan 7 is supplied to each sliding portion of the engine 1 by an oil pump via an oil strainer to be described later. The engine oil used for lubrication is recovered again into the oil pan 7 via the opening portion 63. As shown in FIG. 2, the opening portion 63 is formed in the bottom wall portion 61 to be large. Therefore, the rigidity of the periphery of the opening portion 63 is low, and the opening is easily deformed. Therefore, vibrations caused by the combustion stroke, the crankshaft 6*a*, and the like are easily transmitted to the periphery of the opening portion 63. As a result, vibration may be transmitted to the oil pan 7, and the vibration noise may increase.

Figure 3:
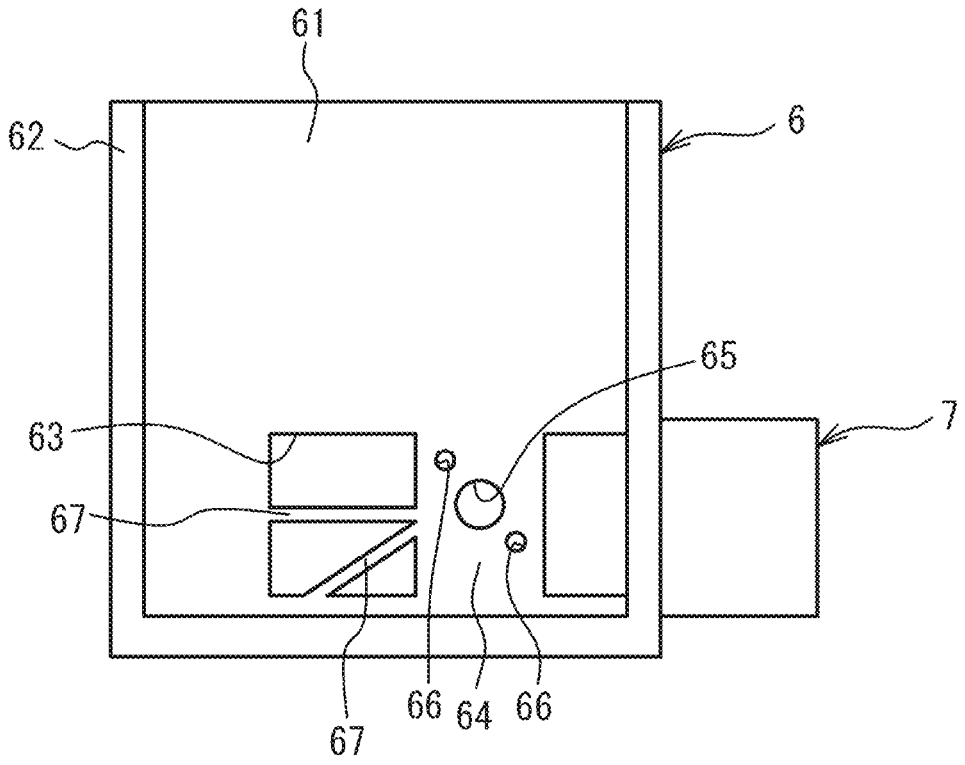
FIG. 3 is a top view of the crankcase and the oil pan of the present embodiment.

FIG. 3 is a view of the crankcase 6 and the oil pan 7 of the present embodiment viewed from above. In the crankcase 6, the reinforcing plate portion 64 is formed so as to span the opening portion 63. In other words, the reinforcing plate portion 64 extends from one of the opposite edges of the opening portion 63 to the other. The reinforcing plate portion 64 is formed integrally with the crankcase 6. The reinforcing plate portion 64 is formed in a flat plate shape. This ensures rigidity around the opening portion 63. As a result, the vibration is suppressed from being transmitted to the oil pan 7, and the vibration noise is suppressed.

Further, a plurality of rib portions 67 extend from the edge of the opening portion 63 to the reinforcing plate portion 64.

Such a rib portion 67 also ensures rigidity around the opening portion 63 and suppresses vibration noise. In this embodiment, the number of the rib portions 67 extending from the edge of the opening portion 63 to the reinforcing plate portion 64 is two, but the present disclosure is not limited thereto.

As shown in FIG. 3, a through hole 65 is formed in the reinforcing plate portion 64. The through hole 65 is formed by an oil strainer, which will be described later, in order to secure the suction of the engine oil. Two bolt holes 66 are formed in the reinforcing plate portion 64. A bolt for attaching the oil strainer to the reinforcing plate portion 64 is inserted into the bolt hole 66.

Figure 4:
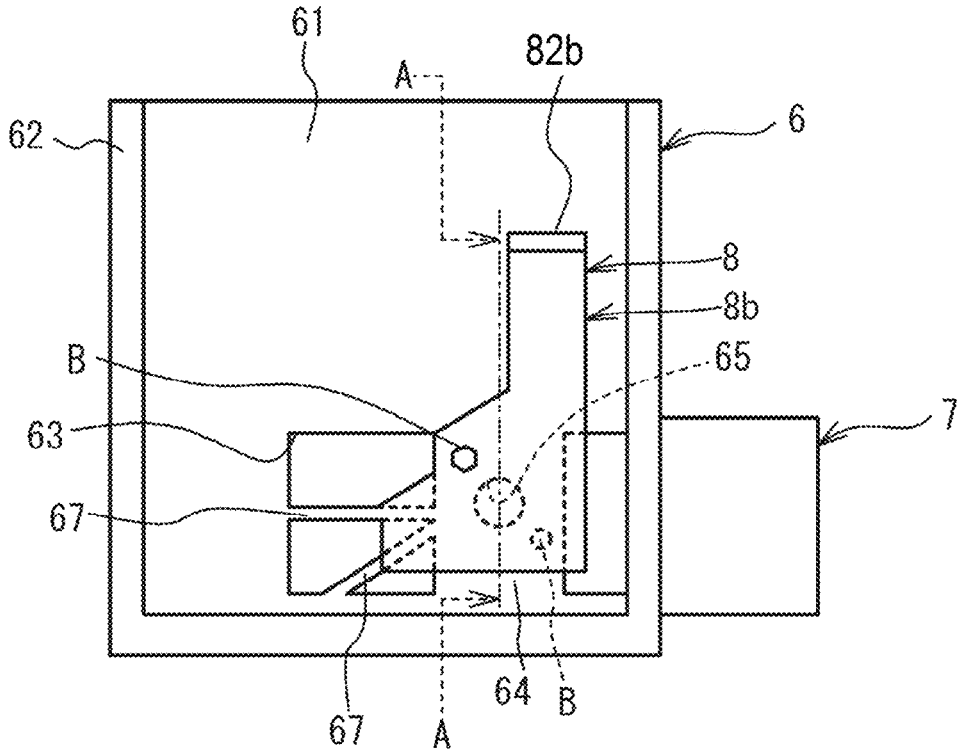
FIG. 4 is a top view of an oil strainer, a crankcase, and an oil pan.
Figure 5:
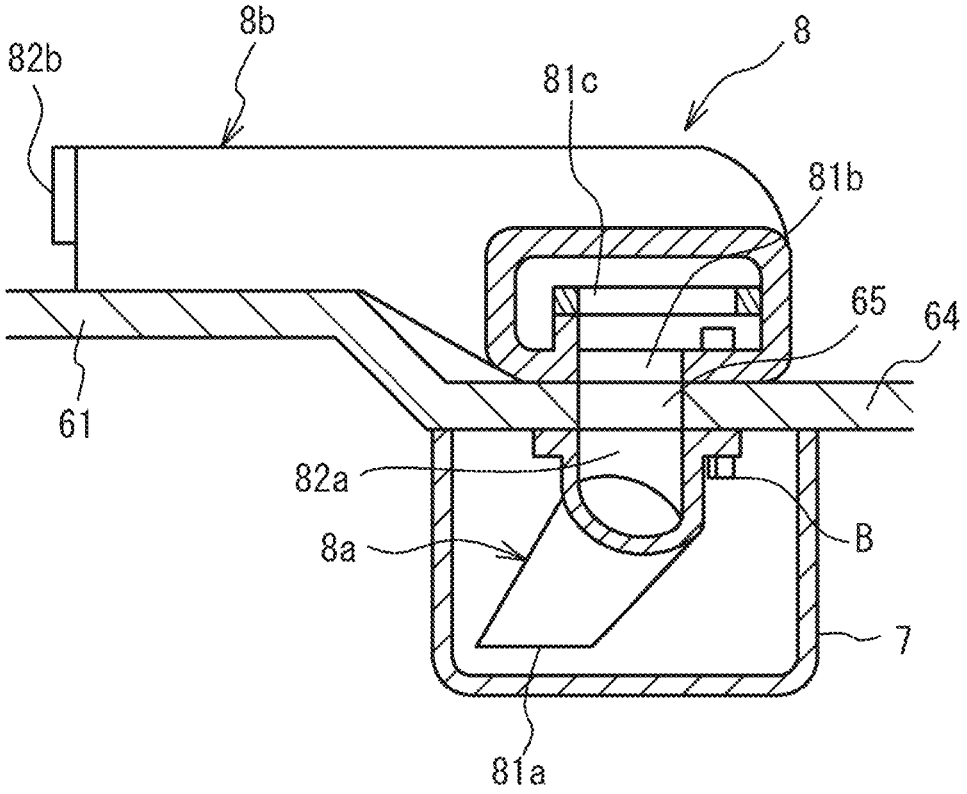
FIG. 5 is a cross-sectional A-A view of FIG. 4.

FIG. 4 is a top view of the oil strainer 8, the crankcase 6, and the oil pan 7. FIG. 5 is a cross-sectional A-A view of FIG. 4. The oil strainer 8 includes a pipe member 8*a* and a case member 8*b*. The pipe member 8*a* is fixed to the lower surface of the reinforcing plate portion 64. The case member 8*b* is fixed to the upper surface of the reinforcing plate portion 64. Specifically, the pipe member 8*a* and the case member 8*b* are fixed by the bolt B via the reinforcing plate portion 64.

The pipe member 8*a* includes a distal end 81*a* and a base end 82*a*. The distal end 81*a* faces the bottom surface of the oil pan 7. The base end 82*a* communicates with the through hole 65 of the reinforcing plate portion 64. In the case member 8*b*, a filter medium 81*c* for filtering the engine oil is provided. The case member 8*b* includes an inlet 81*b* and an outlet 82*b*. The inlet 81*b* communicates with the through hole 65 of the reinforcing plate portion 64. An oil pump is attached to the outlet 82*b* via a pipe (not shown). Accordingly, the engine oil stored in the oil pan 7 is supplied to the respective sliding portions by the oil pump via the pipe member 8*a*, the through hole 65 of the reinforcing plate portion 64, and the case member 8*b*. Thus, the intake of the engine oil by the oil strainer 8 is ensured. The oil strainer 8 is supported in a stable state by the reinforcing plate portion 64.

As shown in FIG. 4, when the case member 8*b* is viewed from above, a part of the case member 8*b* protrudes from the reinforcing plate portion 64 and covers a part of the opening portion 63. Therefore, when the engine oil is collected in the oil pan 7, the engine oil is suppressed from falling directly to the stored engine oil of the oil pan 7 through the opening portion 63. As a result, generation of air bubbles in the engine oil stored in the oil pan 7 is suppressed. As a result, a decrease in oil pressure caused by bubbles in the engine oil is suppressed, and the sliding portions of the engine 1 are appropriately lubricated.

Although the embodiments of the present disclosure have been described in detail above, the present disclosure is not limited to such specific embodiments, and various modifications and changes can be made within the scope of the gist of the present disclosure described in the claims.

What is claimed is:

1. An engine comprising:

a crankcase that has an opening portion in a lower portion;

an oil pan connected to the lower portion of the crankcase so as to block the opening portion; and an oil strainer including a pipe member and a case member, wherein the crankcase includes a reinforcing plate portion formed integrally with the crankcase so as to span the opening portion, the reinforcing plate portion includes two bolt holes and a through hole between the two bolt holes, the case member has an inlet port and an outlet port, and fixed to an upper surface of the reinforcing plate portion such that the inlet port communicates with the through hole, the pipe member is fixed to a lower surface of the reinforcing plate portion so as to communicate with the through hole, the oil strainer and the reinforcing plate portion are attached by respective bolts inserted into the respective two bolt holes, and the crankcase includes a first rib portion extending from a first edge of the opening portion to the reinforcing plate portion, and a second rib portion extending from a second edge of the opening portion to the reinforcing plate portion.

2. The engine according to claim 1, wherein the case member protrudes from the reinforcing plate portion and covers a part of the opening portion when the crankcase is seen from above.

* * * * *